US005644960A

United States Patent [19]

O'Brien

[11] Patent Number: 5,644,960

[45] Date of Patent: Jul. 8, 1997

[54] ADJUSTABLE LOCKING WRENCH

[75] Inventor: William P. O'Brien, 13326 SW. 26th St., Davie, Fla. 33325

[73] Assignee: William P. O'Brien, Davie, Fla.

[21] Appl. No.: 348,500

[22] Filed: Dec. 2, 1994

[51] Int. Cl.[6] ..... B25B 7/12

[52] U.S. Cl. ..... 81/363; 81/367; 81/418

[58] Field of Search ..... 81/355–383, 421–423, 81/165

[56] References Cited

U.S. PATENT DOCUMENTS

| | | | |
|---|---|---|---|
| 1,444,793 | 2/1923 | Keller | 81/165 |
| 1,489,458 | 8/1924 | Petersen . | |
| 2,417,013 | 3/1947 | Petersen . | |
| 2,481,435 | 9/1949 | Meunier . | |
| 2,618,188 | 11/1952 | Emmett . | |
| 3,098,541 | 7/1963 | Kadas | 81/419 X |
| 3,210,070 | 10/1965 | Lagana, Jr. . | |
| 3,564,956 | 2/1971 | Landen . | |
| 3,664,346 | 5/1972 | Dunn | 81/424.5 X |
| 3,699,595 | 10/1972 | Tofflemire | 81/424.5 X |
| 4,386,543 | 6/1983 | Walker, Jr. | 81/420 |
| 4,478,114 | 10/1984 | Arena . | |
| 5,113,727 | 5/1992 | Foster | 81/421 X |
| 5,143,359 | 9/1992 | Bush | 81/423 X |
| 5,305,669 | 4/1994 | Kimbro et al. | 81/423 |

*Primary Examiner*—D. S. Meislin

*Attorney, Agent, or Firm*—Merchant, Gould, Smith, Edell, Welter & Schmidt

[57] ABSTRACT

A parallel, slidable and lockable jaw wrench is disclosed with an over-center locking handle mechanism. The parallel, slidable and lockable jaw wrench has different interchangeable head assemblies adaptable for locking different types of objects depending on the particular head assembly used. Each respective interchangeable head assembly has a horizontally slidable first jaw with a working surface that is adjacent to a working surface of a fixed second jaw that extends from the handle. The slidable first jaw utilizes a plurality of ball bearings disposed within a channel to slide toward and away from the fixed second jaw smoothly. Also, the slidable jaw locks in any spaced apart distance from the first fixed jaw.

52 Claims, 11 Drawing Sheets

ADJUSTABLE LOCKING WRENCH

BACKGROUND OF THE INVENTION

1. Field of the Invention

This invention relates in general to a wrench, and in particular, to a parallel, slidable and lockable jaw wrench having different head assemblies adapted for locking fasteners such as the hexagonal nut and bolt, metal plates, metal pipe or other material positioned between a particular head assembly.

2. Description of Related Art

Two typical wrenches include the adjustable wrench and the locking pliers. U.S. Pat. No. 17,531, entitled "Improved Wrench", issued on Jun. 9, 1857 to E. J. Worcester, discloses the original adjustable wrench. U.S. Pat. No. 1,489,458 entitled "Wrench", issued on Apr. 8, 1924 to W. Petersen, relates to the original locking pliers. Each of these two wrenches have existed for a considerable length of time, and many improvements to each have occurred, such as those described in U.S. Pat. Nos. 2,201,918, 3,545,315 and 3,545,316. During the period of time since the invention of these tools, each has become recognized for their own specific qualities, advantages, purposes, and shortcomings.

First, the adjustable wrench is primarily used to tighten or loosen either square or hexagon nuts or bolts. The adjustable wrench includes a body having a stationary jaw and a channel through which a moving jaw can be moved toward or away from the stationary jaw. The body also functions as a handle. Typically a toothed rack and nontraveling or captive rotatable pinion are interconnected to cause the movable jaw to move toward and away from the stationary jaw. The pinion is turned by the thumb or finger and meshes with the toothed rack on the slidable jaw to drive the slidable jaw back and forth along the rotatable pinion. Thus, the jaws are moved closer together or farther apart, depending on the rotational direction of the pinion. This type of wrench is adjustable from a fully closed position to a fully opened position by rotating the pinion. When properly adjusted, the opening will receive a hexagonal nut of any dimension that will slide between the two opened jaws.

The locking pliers is primarily used to tightly lock on objects and also includes a body having a stationary jaw and a movable jaw. The movable jaw is pivoted at the main body and rotates toward and away from the stationary jaw along an arc described by the distance from the pivot point at the main body to the end of the movable jaw. The locking pliers also has an over-center locking mechanism. The movable jaw is pivotally connected to a handle between the movable jaw's pivot point and the end of the jaw. The over-center locking rod is pivotably connected to the handle and coupled to an adjusting bolt through a spring and is located in the handle of the main body. When the adjusting bolt is rotated to move in or out of the base of the main body handle the geometry formed by the contact points of the over-center locking rod, the movable handle, and the movable jaws changes. Thus, the jaws can be locked in position since the geometry forms a fulcrum in which the over-center locking mechanism prevents jaw movement in the open direction.

However, both above-described devices lack certain features. For example, the necessary tolerances of the pinion and the rack in the adjustable type wrench facilitate easy operation, but once tightened around a nut or other fastener, those same tolerances cause "slop" or slight movement of the slidable jaw. This movement, when combined with a certain amount of torque, can result in the slidable jaw opening sufficiently to cause the wrench to slip off the nut.

This slippage may cause damage to the geometry of the nut and also may tear into the surface of whatever the wrench is attached to, or may cause injury to the user. Experiences associated with these characteristics have given the adjustable wrench nicknames like "Knuckle Buster" and "Nut Wrecker", referring to banged or bruised knuckles on the human hand and damaged nut type fasteners, respectively.

Because of the possibility for slippage while using an adjustable wrench, many people have used the locking pliers in their place. U.S. Pat. No. 1,489,458 issued to Petersen teaches the working faces of the jaws of the typical locking pliers to be roughened to facilitate their gripping action when the tool is employed as a wrench. Use of the locking plier with hexagonal nut fasteners is usually associated with some type of damage to the nut since the faces of the jaws of the locking pliers do not geometrically contour with the fasteners. When sufficient force is applied to the handles of the locking pliers, enough mechanical advantage exists to cause the roughened faces of the jaws to act like a splitting wedge, thus breaking the nut, leading to the nickname of "Nut Cracker".

When the geometry of the contact between the faces of the jaws of the locking pliers and the faces of the hexagonal fasteners is examined in close detail, it becomes obvious that very poor surface contact results. This is due to shape of the faces, aggravated by the way in which the jaws are brought closer together. The movable jaw in the locking pliers is brought closer to the stationary jaw by angular rotation. The faces of the movable jaw and the stationary jaw are parallel to each other at only a single point in the arc of rotation of the movable jaw. At this point, the distance between the faces of the jaws is fixed, and although the jaws are parallel at this point, the roughened faces will provide very poor surface contact with a nut that fits exactly between the faces. Further, some slippage or damage to the fastener can occur even under these conditions where the jaw faces are parallel with the faces of the fasteners. At any other position along the arc, the jaw faces are nonparallel, and thus cannot provide the geometry necessary to grip hexagonal or square nut fasteners correctly. Moreover, both wrenches have jaws that are fixed configurations and do not facilitate the gripping of various other objects.

Whatever the merits of the prior wrenches, they do not achieve the benefits of the present invention.

SUMMARY OF THE INVENTION

To overcome the limitations in the prior art described above, and to overcome other limitations that will become apparent upon reading and understanding the present specification, the present invention discloses a parallel, slidable and lockable jaw wrench. The wrench has a body defined by a first fixed jaw located at a top section and longitudinally extending therefrom to form a bottom section. The first fixed jaw includes an upper channel and a lower channel substantially parallel to the upper channel. A second movable jaw is coupled within the lower channel and upper channels of the fixed jaw for slidably moving within the upper and lower channels. Also, the movable jaw is infinitely movable a desired spaced apart distance from the fixed jaw. A handle is pivotally interconnected to the movable jaw by a cam for locking and unlocking the movable jaw the spaced apart distance from the fixed jaw. A threaded shaft is coupled to the handle for infinitely adjusting the distance between the first fixed jaw and the second movable jaw. In addition, a spring is connected between the cam and the body for resiliently biasing the cam. Further, interchangeable teeth can be supplemented.

An object of the invention is to allow secure gripping of a bolt without damage to the bolt. Another object of the invention is to allow safe gripping of the bolt so that the wrench does not slip off a nut or bolt when locked to the nut or bolt. Yet another object of the invention is to allow the gripping of various objects by way of the interchangeable head assemblies or by being embodied in wrenches with different and similar head assemblies.

A feature of the wrench of the present invention is that the wrench has a movable jaw which slides parallel to the fixed jaw to facilitate the locking of a geometrically shaped bolt or nut or any opposed parallel surfaces. Another feature of the wrench of the present invention is to have single purpose wrenches with one head assembly preselected. Another feature of the wrench of the present invention is to have interchangeable teeth. Yet another feature of the adjustable wrench of the present invention is a smoothly sliding jaw.

BRIEF DESCRIPTION OF THE DRAWINGS

Referring now to the drawings in which like references represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1A:
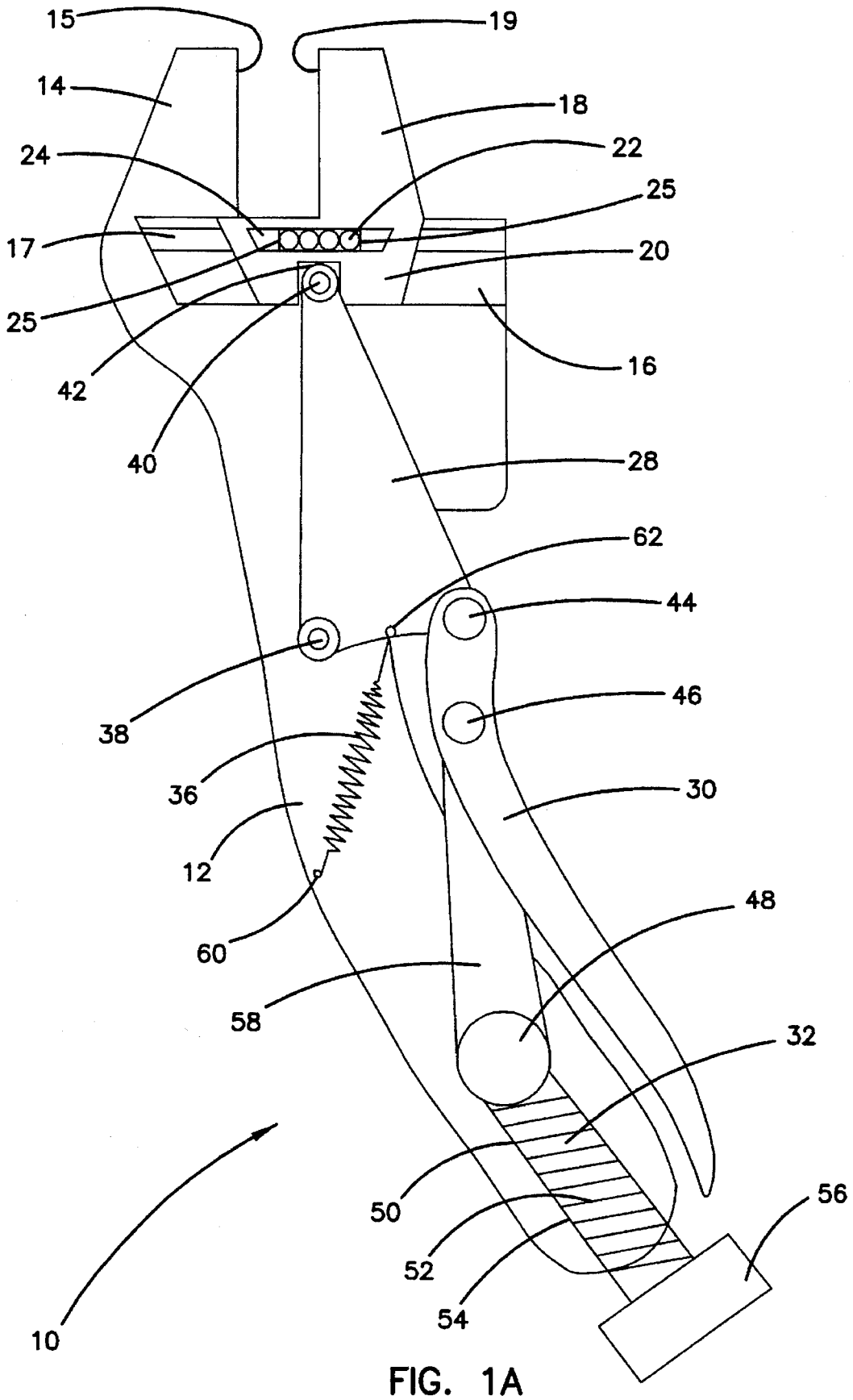
FIG. 1A illustrates the locking adjustable wrench of the present invention.
Figure 2B:
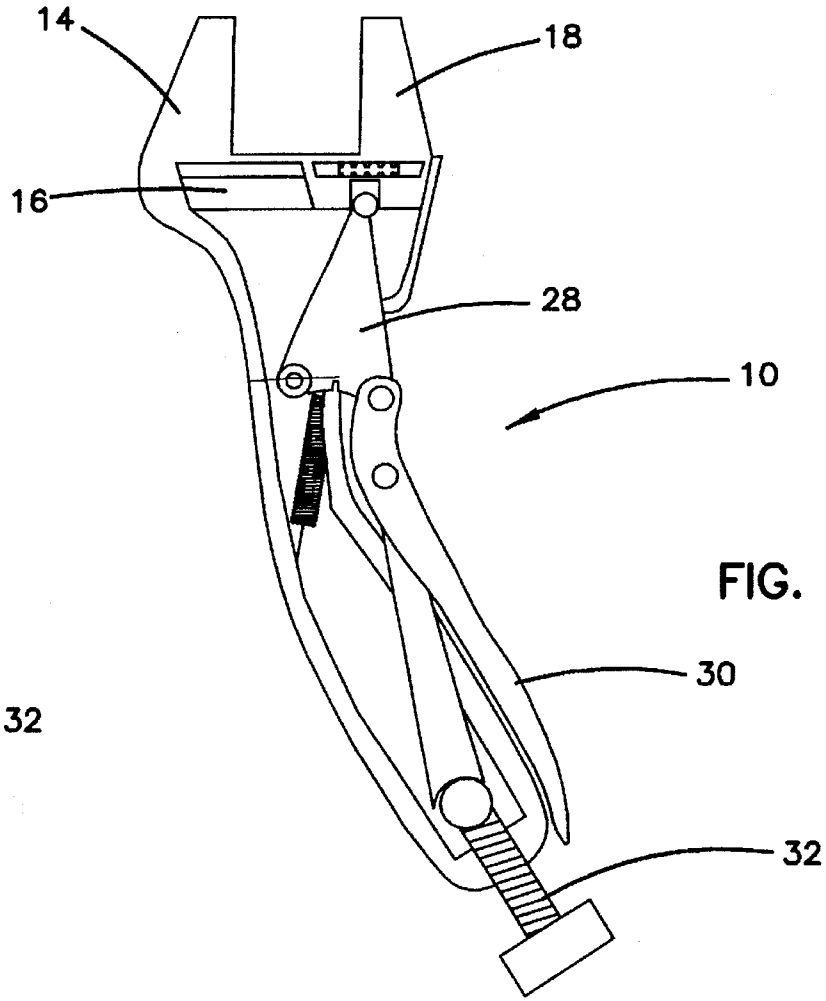
FIG. 2B illustrates the locking adjustable wrench of the present invention in an opened position.
Figure 2A:
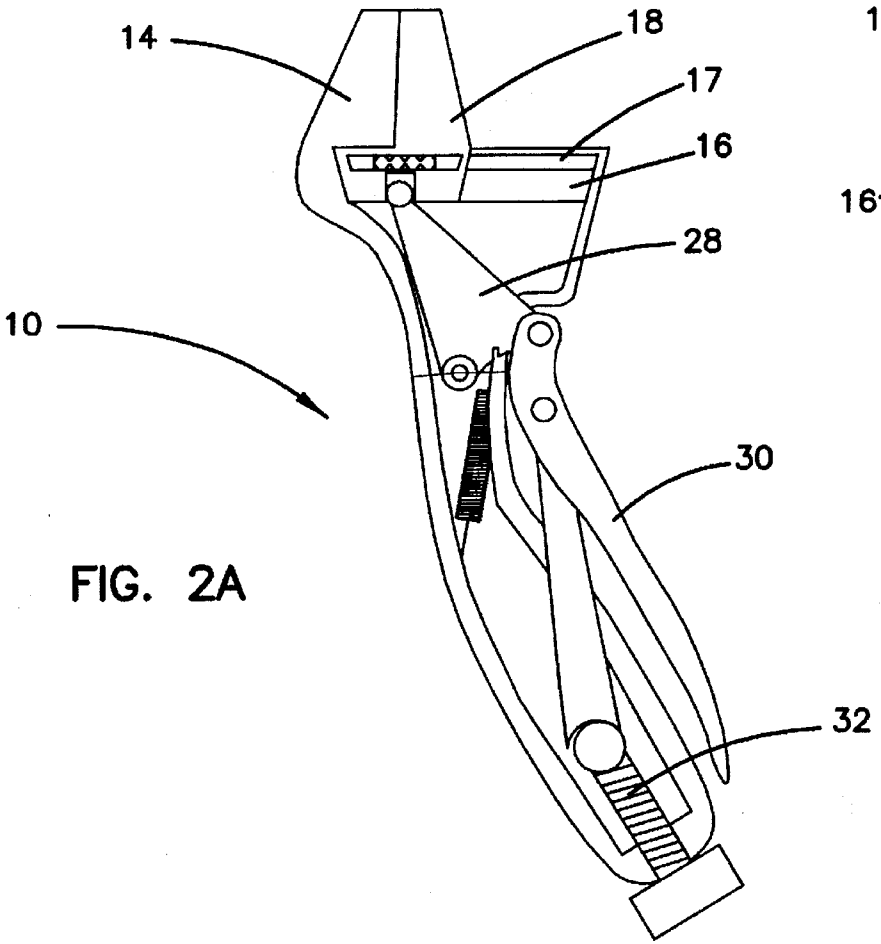
FIG. 2A illustrates the locking adjustable wrench of the present invention in the closed position.
Figure 3A:
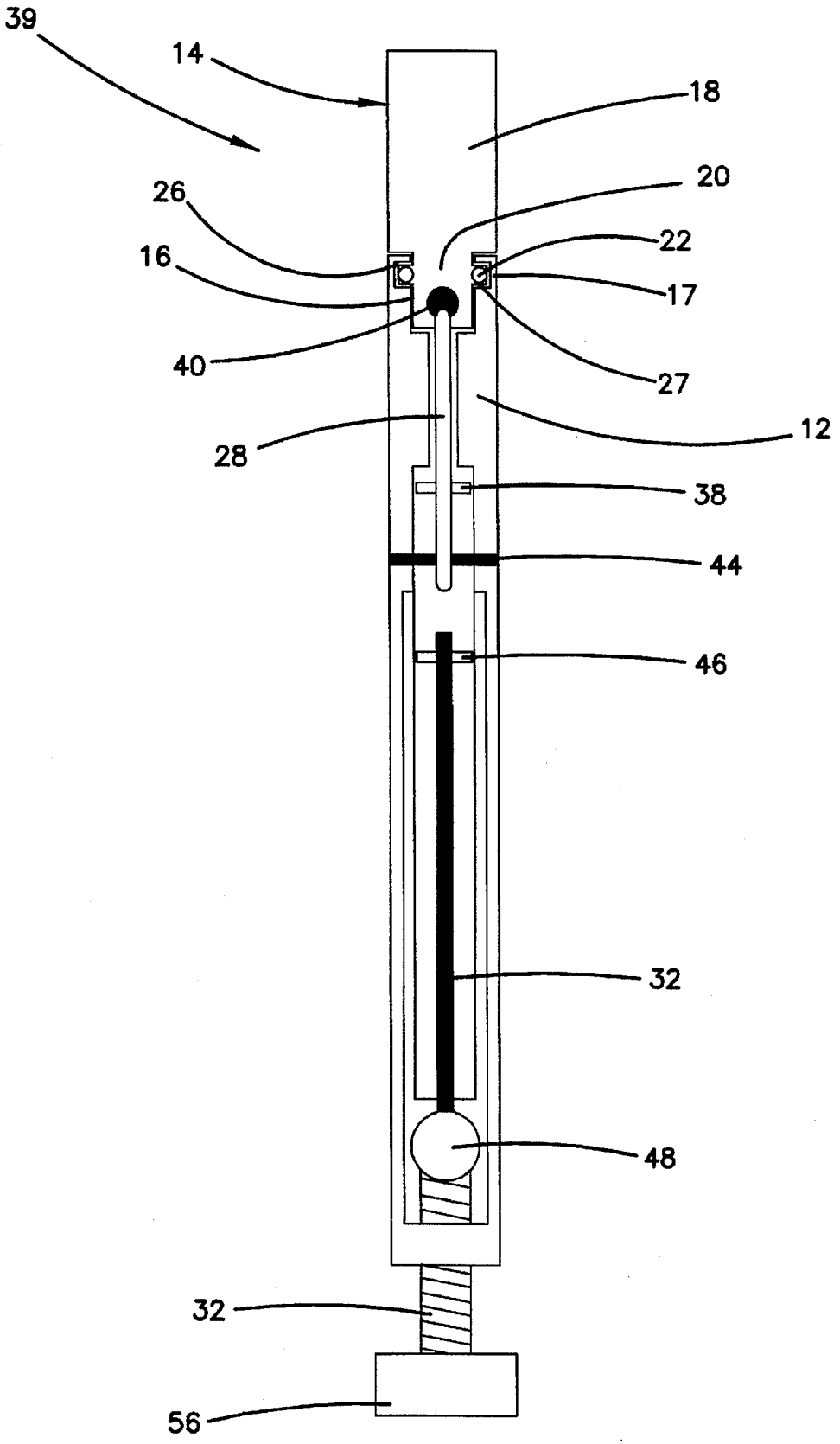
FIG. 3A illustrates a side sectional view of FIG. 1.
Figure 3B:
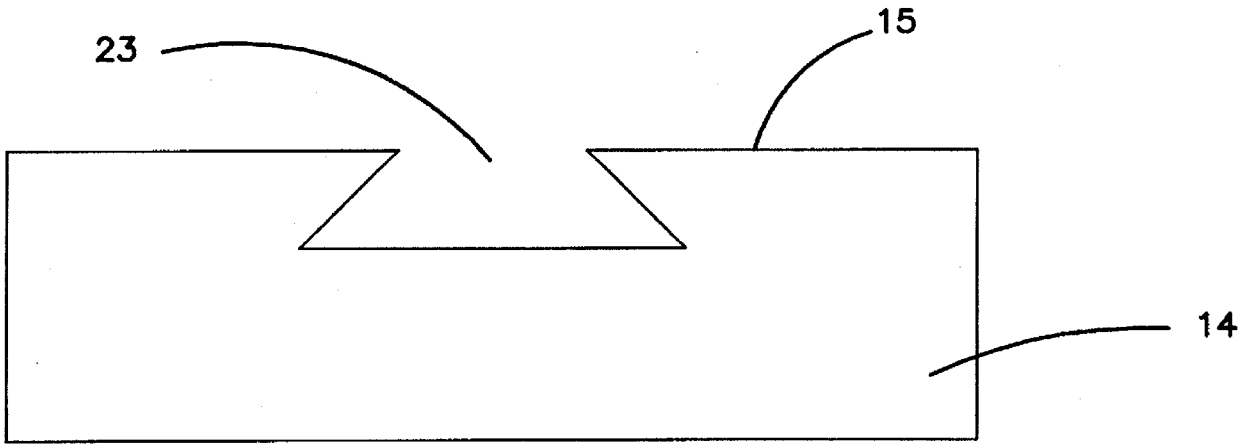
FIG. 3B illustrates a sectional top view of the jaw of an alternative embodiment of the present invention.
Figure 3C:
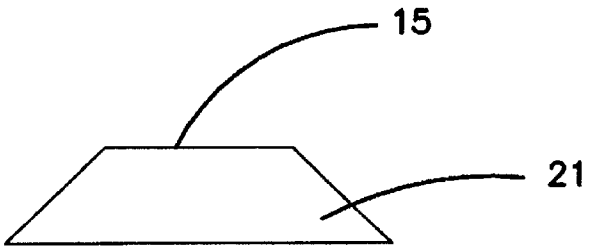
FIG. 3C illustrates the top view of one type of interchangeable teeth of an alternative embodiment of FIG. 3B of the present invention.

FIGS. 1–3 illustrate the locking adjustable wrench of the present invention. Adjustable wrench 10 includes a body 12 having an integral fixed jaw 14 with a substantially flat working surface 15. A lower channel 16, for example in the shape of a key hole, is formed on body 12 just below fixed jaw 14 and an upper channel 17 is also formed on body 12 just above lower channel 16. Wrench 10 further includes a movable jaw 18, with a substantially flat working surface 19, and having a guide 20 defined at the bottom thereof. Working surfaces 15 and 19 are substantially parallel to each other. Guide 20 is shaped similar to lower channel 16 and is adapted to mesh with lower channel 16 so that the movable jaw 18 slides freely therethrough. Thus, when the movable jaw 18 and the guide 20 are inserted into the lower channel 16, the movable jaw 18 may be moved toward or away from the fixed jaw 14. In an alternative embodiment, as shown in FIGS. 3B and 3C, each jaw 14 and 18 may have an angled key 23 for receiving interchangeable teeth 21. The teeth 21 are slidably and removably attached within the angled key 23 at each respective working surface 15 and 19.

A plurality of standard ball bearings 22 are disposed within a gutter 24 of the movable jaw 18 and travel along the upper channel 17 of the fixed jaw 14 to aid in smoothly moving the movable jaw 18 within the lower channel 16. The ball bearings 22 are confined within the gutter 24 and are preferably spaced apart from each other uniformly and can be retained together by a cage or separator 25. The gutter 24 preferably has orthogonally shaped inner ball races located within the center of the gutter wall 26 and within the center of the gutter floor 27 to allow the ball bearings 22 to roll on. Orthogonally shaped inner ball races allows the ball bearings 22 to contact the inner ball races at only three points to thereby reduce wear and tear on the inner ball races as well as on the ball bearings 22.

Figure 1B:
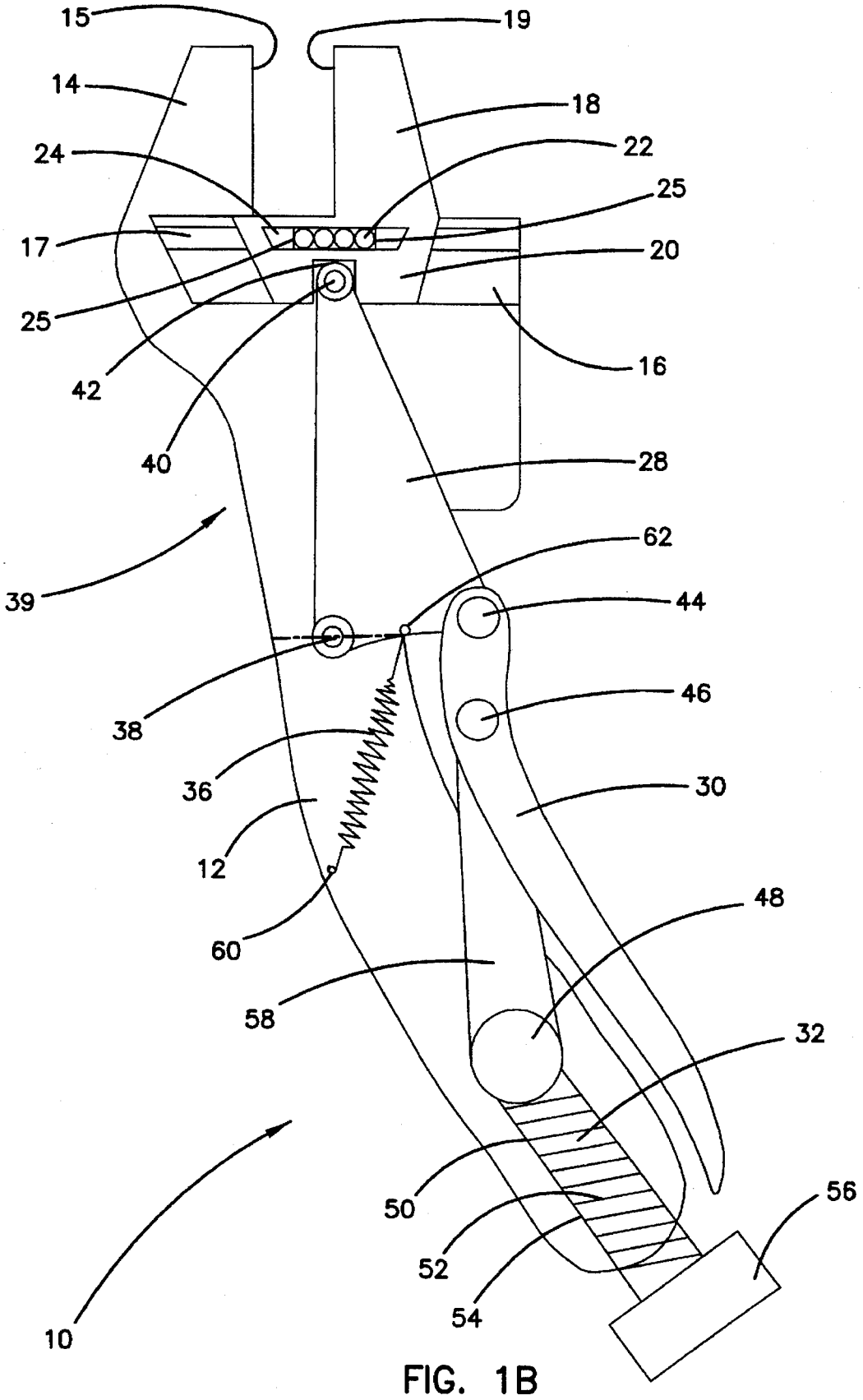
FIG. 1B illustrates the locking adjustable wrench of the present invention.

The movement of the movable jaw 18 of wrench 10 is controlled by a rotating cam 28. Cam 28 is controlled by corresponding movement of a handle 30 which is connected to an over-center locking rod 58. Rod 32 is a biasing adjustment threaded rod and moves up and down when threaded. Rotating cam 28 is biased in a downward position by a retractile spring 36 and pivots about a pivot point 38. Pivot point 38 may be a screw bolt, which is connected through one side of the body 12 to the opposite side as shown in FIG. 3A. Pivot point 38 may releasably connect the head assembly 39 to the body 12 as shown in FIG. 1B. Also, rotating cam 28 can be of a triangular shape and includes an end 40.

End 40 forces movable jaw 18 to slide parallel to a horizontal axis in the lower channel 16 so that the jaws 14 and 18 move from a closed position (FIG. 2A) to an open position (FIG. 2B). Also, the end 40 is removably positioned to mesh within a slot 42 on the guide 20 of the movable jaw 18. The end 40 can be ball-shaped and is positioned within the slot 42. In addition, the end 40 can be locked into cam 28 with a pin, such as a roller bearing. Further, end 40 can be magnetized and the movable jaw 18 can be a ferrous metal. Hence, a magnetic force is created between the end 40 of the cam 28 and the second movable jaw 18 to thereby couple the end 40 to the movable jaw 18.

Also, springs can be utilized to couple the body 12 to the guide 20, or movable jaw 18, so that the movable jaw 18 is biased toward the fixed jaw 14. Alternatively, springs can be attached between the left side of the lower channel 16 and the left side of the movable jaw 18 at the guide 20 to bias the movable jaw 18 away from the fixed jaw 14. In addition, the tension strength on the springs mentioned above can be varied so that the tension bearing on rod 32 is adjustable. This will directly vary the forces on handle 30 at point 44 and point 46 to thereby change the opening and closing forces on the over center cam 28. Thus, the end 40 drives the guide 20 as it slides within the lower channel 16, thereby urging the movable jaw 18 toward the fixed jaw 14. Also, working surfaces 15 and 19 always remain parallel to each other while the jaws 14 and 18 move from the open to the closed position.

The handle 30 is connected to the rotating cam 28 at the pivot point 44. Link 58 is pivotally connected to the handle 30 at pivot point 46. Link 58 extends from the pivot point 46 and pivotally intersects the adjustable rod 32 at rounded end 48 of link 58. The adjustable rod 32 is disposed within a cavity 50 of the body 12 and has threads 52 thereon. The rod 32 is traversed through the cavity 50 by rotating threads 52 of rod 32 through corresponding threads 54 in the cavity 50 of the body 12 by turning head 56. Thus, the clockwise rotation of the rod 32 adjusts the movable jaw 18 toward the fixed jaw 14 to thereby decrease the distance between the jaws 18 and 14. This rotation allows the placing of smaller objects between the working surfaces 15 and 19 of respective jaws 14 and 18, and also tightens the jaws' grip on an object within the jaws 14 and 18. Likewise, counterclockwise rotation of the rod 32 adjusts the movable jaw 18 away from the fixed jaw 14 to thereby increase the distance between the jaws 14 and 18. This allows the placing of larger objects between the working surfaces 15 and 19 of the two jaws 14 and 18 respectively, and also loosens the jaws' grip on an object between the jaws 14 and 18.

Rotating cam 28 is biased by the spring 36 to allow cam 28 to resiliently control the movable jaw 18 in moving away from the fixed jaw 14. Spring 36 is connected between spring catch 60 and spring catch 62. Spring catch 62 may be a hole in the rotating cam 28 and the spring catch 60 may be an extension from the main body 12. When the handle 30 is opened, the spring 36 resiliently biases cam 28 based on the interconnecting pivot points 38, 44, 46 and 48.

To grip an object with the wrench 10 of the present invention, the handle 30 is opened or moved away from the body 12 of the wrench 10, so that point 46 is just slightly right of the center of the line formed between pivot point 44 and fulcrum 48. The adjustment rod 32 is then rotated until the jaws 14 and 18 open wide enough to allow an object to slip within the jaws 14 and 18. The handle 30 is then moved back toward the body 12 until the jaws 14 and 18 lock onto the object such that the centerline of pivot point 46 is to the left of the center of the line formed between pivot point 44 and fulcrum 48. This creates an over center force which locks jaws 14 and 18 into the desired position. Thus, if the center of pivot point 46 is to the right of the line formed between pivot point 44 and the fulcrum 48, the jaws 14 and 18 are unlocked. If the center of pivot point 46 is to the left of the line formed between pivot point 44 and the fulcrum 48, the jaws 14 and 18 are locked. The locking location of movable jaw 18 is a function of the actual position of the center of pivot point 46. The center of pivot point 46 will move depending on the degree or depth which rod 32 is screwed in or out.

FIGS. 4–8 illustrate head assemblies of the present invention. Each head assembly 39 is connected to the body 12 of the wrench 10 and is adaptable for locking different types of objects depending on the particular head assembly used. Also, each head assembly is coupled to the body 12 in a similar fashion and operates in a similar manner as the wrench 10 of FIGS. 1–3. However, each head assembly has a different working surface than the working surface of the wrench 10 of FIGS. 1–3.

Figure 4:
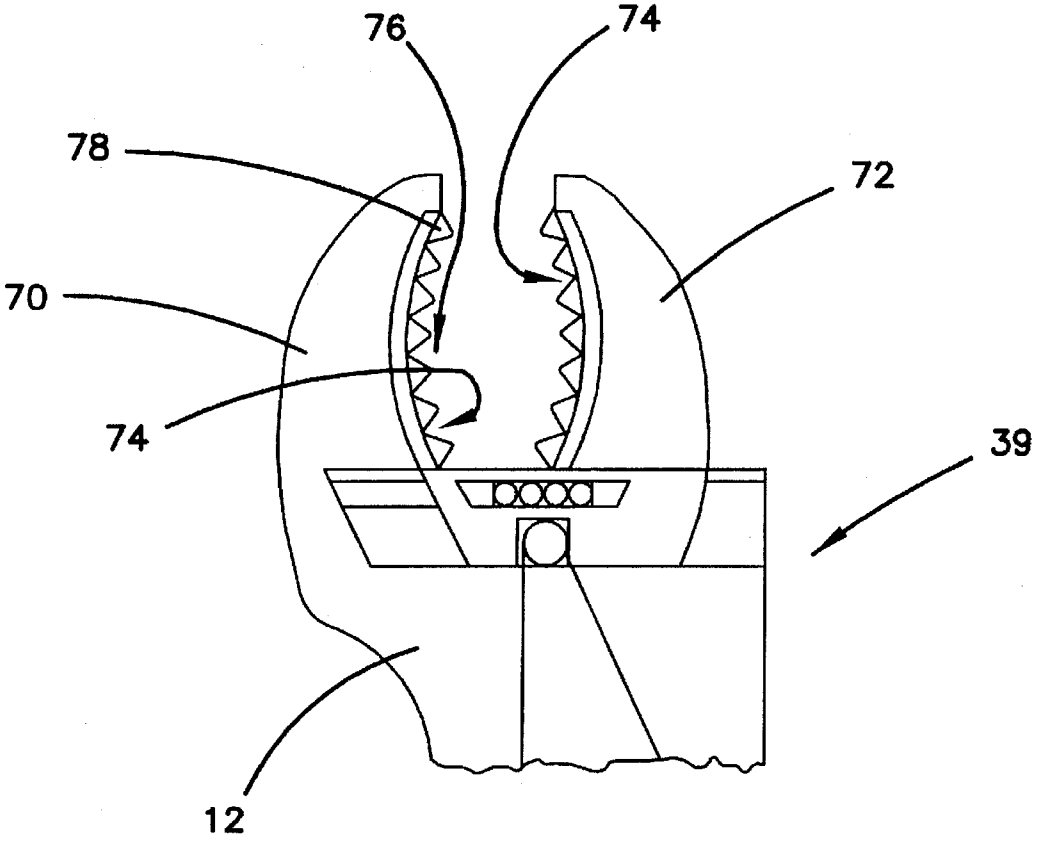
FIG. 4 illustrates the curved jaws of the present invention.

Specifically, FIG. 4 illustrates an interchangeable head assembly having arcuately shaped jaws 70 and 72. The working surface 74, or outer face, of each jaw is transversely corrugated 76, defined by a plurality of teeth 78, to facilitate the secure gripping an object. Also, the arcuate shape of the jaws allows the jaws 70 and 72 to be used on round objects, such as a pipe or tubing. In addition, the corrugated edges 76 on each jaw 70 and 72 allows the gripping of hex nuts and bolts at four points, which increases gripping power. Further, because of the variable distance created by the movable jaw 72, an infinite range of geometrically shaped objects can be gripped.

Figure 5B:
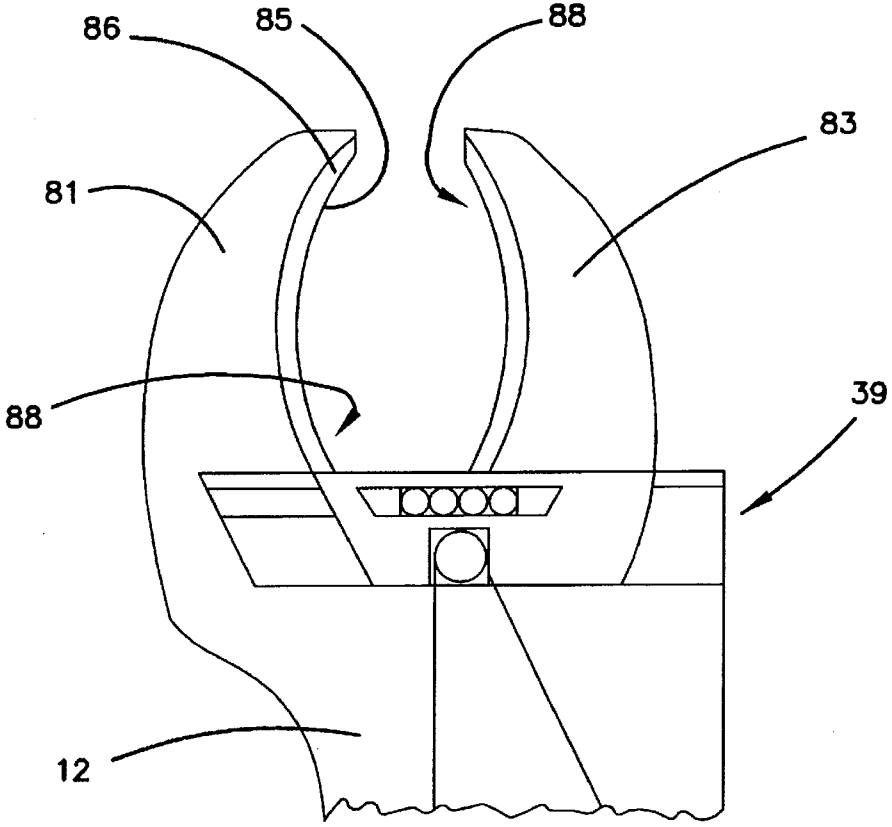
FIG. 5B illustrates the cutting jaws of the present invention.
Figure 5A:
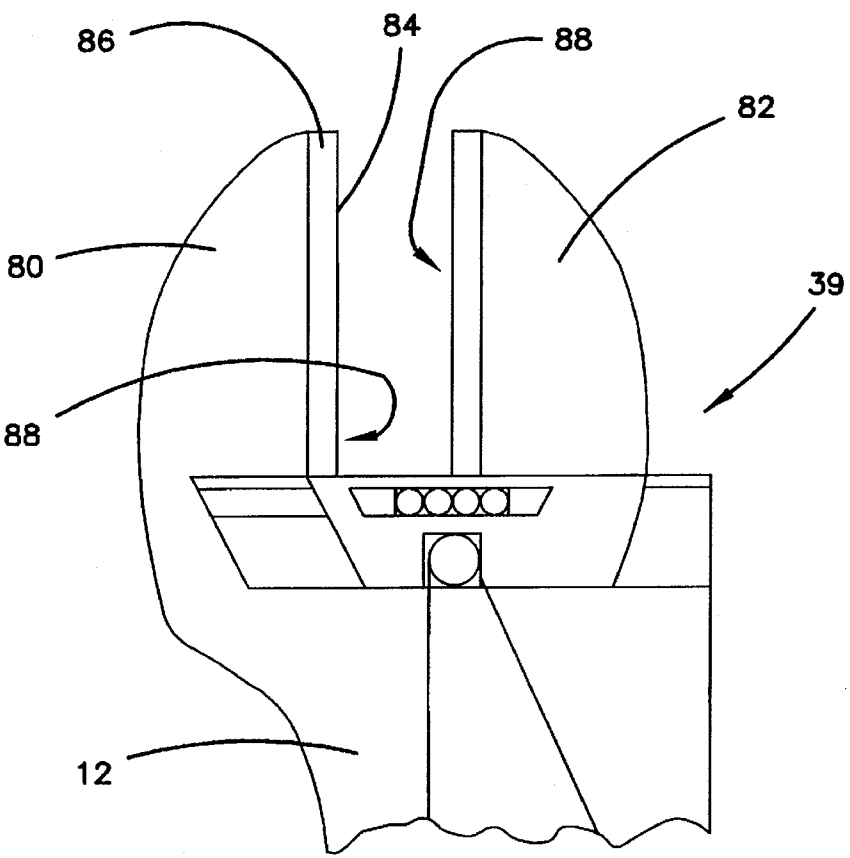
FIG. 5A illustrates the pinch-off jaws of the present invention.

FIG. 5A illustrates a head assembly having jaws 80 and 82 with angled edges 84. Each jaw has a lip 86 that converges toward each respective working surface 88 to form the angled edge 84 on each jaw 80 and 82. Thus, the angled edge 84 on each jaw 80 and 82 creates a sharper and smaller working surface area then the jaws of the wrench 10 of FIGS. 1–3, thereby facilitating the pinching of objects, such as PVC tubing or copper piping, so that the flow of fluid within the interior of the tubing or piping is cut off. FIG. 5B illustrates the head assembly of FIG. 5A having arcuately shaped jaws 81 and 83 with angled edges 85. Instead of pinching objects, these jaws 81 and 83 cleanly cut piping or the like due to the arcuately shaped jaws 81 and 83.

Figure 6:
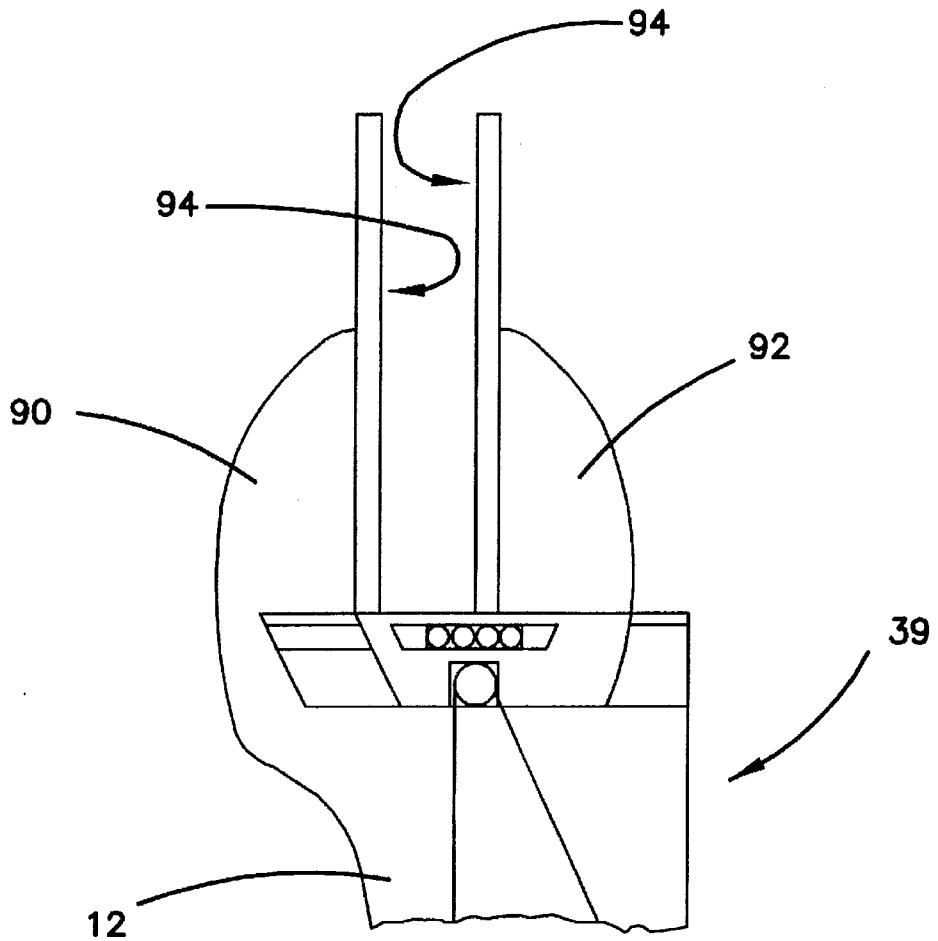
FIG. 6 illustrates the duckbill jaws of the present invention.

FIG. 6 illustrates a head assembly having duckbill jaws 90 and 92. Each duckbill jaw 90 and 92 has a wide and elongated flat faced working surface 94. The duck bill jaws are for clamping flat objects, such as sheet metal, between the jaws 90 and 92. Also, the duck bill head assembly can be used to crimp and bend edges of sheet metal or similar material.

Figure 7:
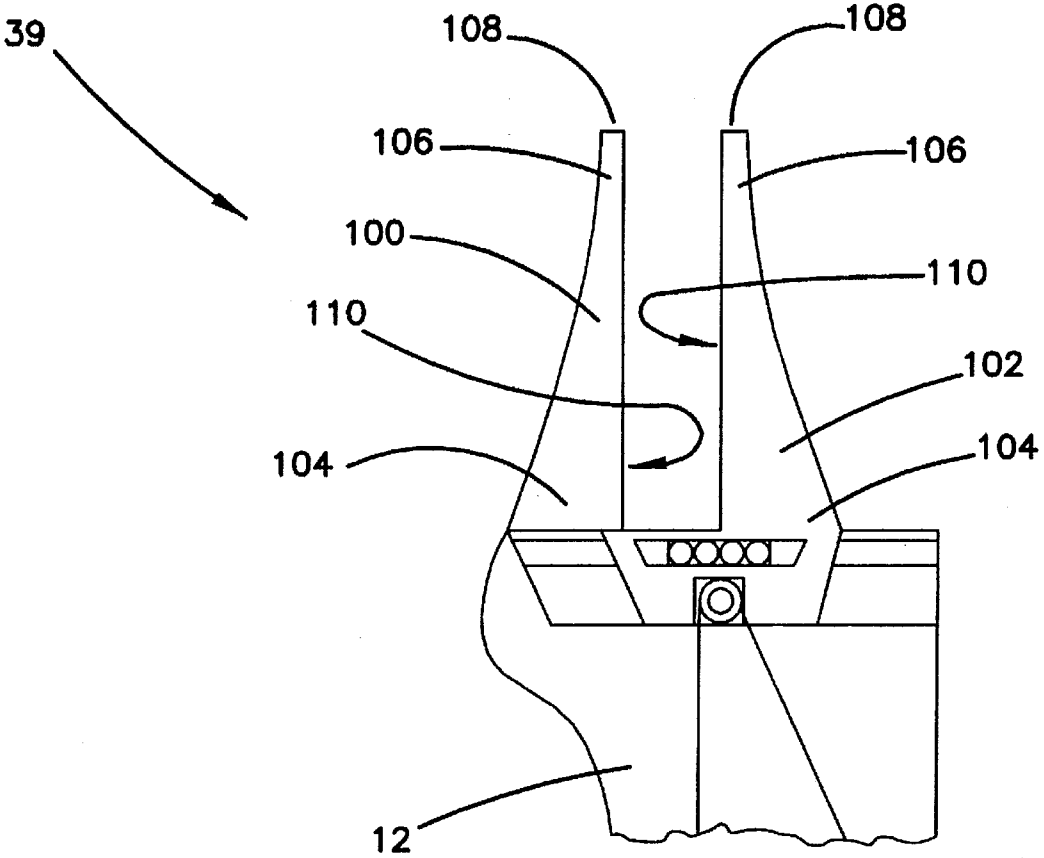
FIG. 7 illustrates the needle nose jaws of the present invention.

FIG. 7 illustrates a tapered needle nose head assembly. Each jaw 100 and 102 has a nose base 104 and a nose tip 106. Each nose base 104 is located near the body 12 and each nose tip 106 is opposite the nose base 104 and located at the end of each jaw 100 or 102. Each jaw 100 and 102 narrows from each nose base 104 to each nose tip 106 creating a tapered jaw defining a point 108, or needle nose, at the nose tip 106 to form a narrow working surface 110. Thus, the needle nose jaws 100 and 102 facilitate the gripping of objects that are located in areas that have limited spacing, such as holes or crevices.

Figure 8B:
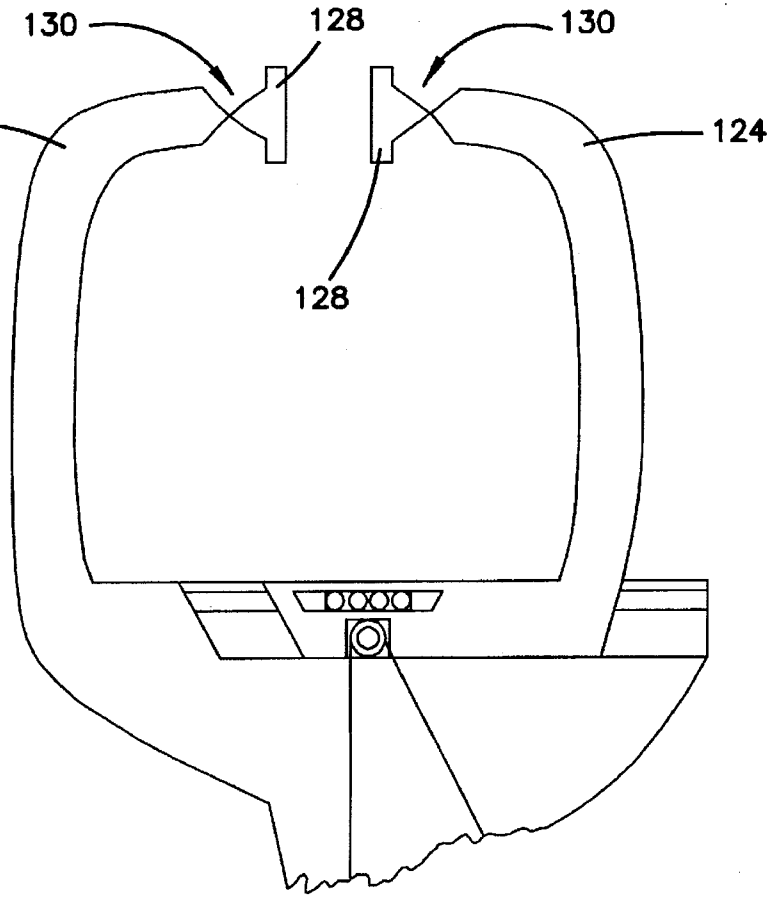
FIG. 8B illustrates an alternative embodiment of the jaws of FIG. 8A.
Figure 8A:
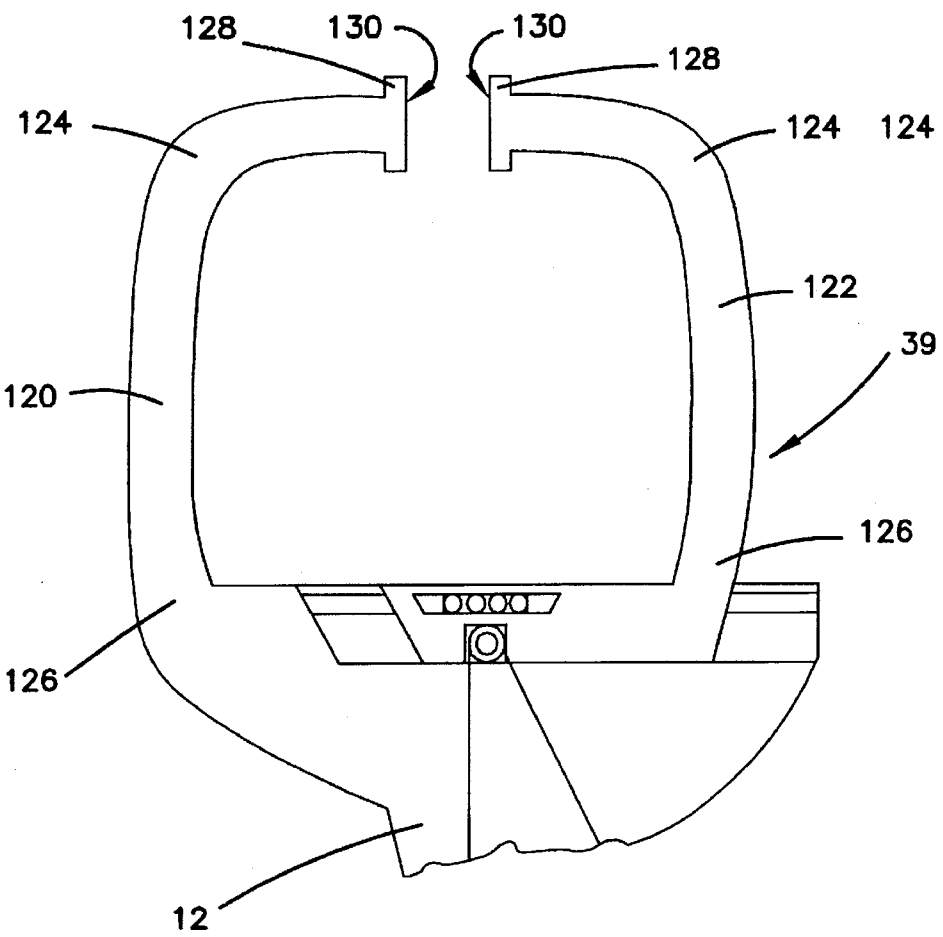
FIG. 8A illustrates the C-clamp jaws of the present invention.
Figure 8C:
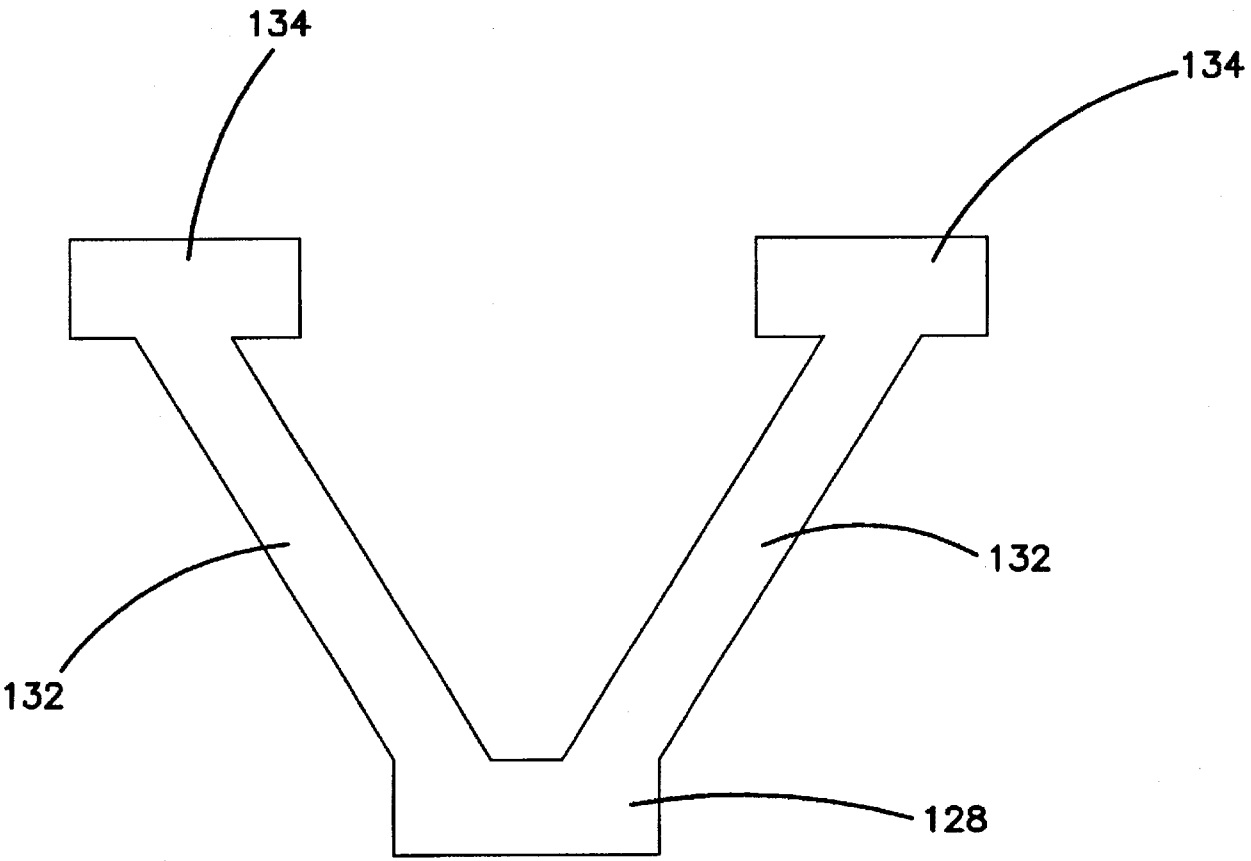
FIG. 8C illustrates a top view of an alternative embodiment of the jaws of FIG. 8A.

FIG. 8A illustrates a C-clamp head assembly. Each jaw 120 and 122 has arcuate arms 124 extending from a shoulder 126, located near the body 12, to a flat head 128 forming the working surface 130. The flat head 128 may be pivotally attached 130 to the shoulder 126 as shown in FIG. 8B. This allows flat head 128 to rotate about shoulder 126 so that the handle of the wrench 10 can be manipulated while objects are clamped within the flat heads 128. In addition, the head 128 may have splayed fingers 132 with flat heads 134 to clamp objects at more than one point as shown in FIG. 8C. The head 128 may also be pivotally attached to shoulder 126. The C-clamp head assembly is used for clamping large objects together while working in close areas or for holding objects that are being machined. Also, the C-clamp can be used to clamp angle iron, clamp I-beams, hold work pieces for gluing, welding, and soldering, and to hold work on a drill-press table.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not this detailed description, but rather by the claims appended hereto.

What is claimed is:

1. A wrench, comprising:

a body having a first fixed jaw;

a second movable jaw residing within a lower channel formed on the body, the lower channel residing below an upper channel formed on the body within which a plurality of ball bearings are disposed, the plurality of ball bearings being uniformly spaced apart from each other and retained together by a cage separator;

a rotating cam pivotably connected to the body at a first point, wherein the rotating cam interacts with the second movable jaw at a point midway between opposite ends of the base of the second movable jaw; and a handle fixedly connected to the rotating cam at a second point so that action of the handle effects a range of motion in the second movable jaw within the channel towards a fully open position and a fully closed position relative to the first fixed jaw.

2. The wrench of claim 1, wherein the handle is pivotably connected to a link at a pivot point between opposite ends of the handle, wherein the position of the pivot point relative to the body is determined by linear adjustment of the link, and the linear adjustment of the link is determined by an adjusting screw adjacent the link, so that linear adjustment in the link is converted to angular motion in the rotating cam.

3. The wrench of claim 2, wherein the second movable jaw is locked when the pivot point located between opposite ends of the handle is closer to the body than a centerline formed between the end of the link adjacent to the adjusting screw and the end of the handle coupled to the cam.

4. The wrench of claim 2, wherein the adjusting screw is coupled to the handle for adjusting the spaced apart distance between the first fixed jaw and the second movable jaw.

5. The wrench of claim 1, further comprising a spring interconnected between the body and the cam for resiliently influencing the cam.

6. The wrench of claim 1, wherein the spring maintains contact between the link and the adjusting screw.

7. The wrench of claim 1, wherein the upper channel is substantially parallel to the channel.

8. The wrench of claim 1, wherein the upper channel has orthogonally shaped inner ball races defined by the side wall of the upper channel and by the floor of the upper channel.

9. The wrench of claim 1, wherein the first fixed jaw and the second movable jaw further comprises interchangeable teeth and means for removably interconnecting the interchangeable teeth to each jaw.

10. The wrench of claim 1, wherein the cam is magnetized and the second movable jaw is a ferrous metal so that a magnetic force is created between the cam and the movable jaw to thereby couple the cam to the movable jaw.

11. The wrench of claim 1, wherein the jaws comprise arcuately shaped jaws, wherein the working surfaces of each jaw is transversely corrugated and defined by a plurality of teeth for the secure gripping of an object.

12. The wrench of claim 1, wherein the jaws each have a lip converging toward the working surface to form an angled edge on each jaw so that a sharp and small working surface area is created, thereby facilitating the pinching of objects within the working surfaces.

13. The wrench of claim 1, wherein the jaws are arcuately shaped.

14. The wrench of claim 1, wherein the jaws comprise duckbill jaws having a wide and elongated flat working surface.

15. The wrench of claim 1, wherein the jaws comprise a nose jaw having a nose base located near the body of the wrench and narrowing away from the nose base to form a needle nose tip, thereby facilitating the gripping of objects that are located in areas that have limited spacing.

16. The wrench of claim 1, wherein the jaws comprise a C-clamp jaw having arcuate arms extending from a shoulder located near the body of the wrench to form a head defined by a flat working surface area, thereby facilitating the clamping of small objects together while working in close areas.

17. The wrench of claim 1, wherein the jaws comprise splayed fingers.

18. A wrench, comprising:

a body having a first fixed jaw;

a second movable jaw residing within a lower channel formed on the body, the lower channel residing below an upper channel formed on the body, the upper channel having orthogonally shaped inner ball races defined by the side wall of the upper channel and by the floor of the upper channel and within which a plurality of ball bearings are disposed;

a rotating cam pivotably connected to the body at a first point, wherein the rotating cam interacts with the second movable jaw at a point midway between opposite ends of the base of the second movable jaw; and a handle fixedly connected to the rotating cam at a second point so that action of the handle effects a range of motion in the second movable jaw within the channel towards a fully open position and a fully closed position relative to the first fixed jaw.

19. The wrench of claim 18, wherein the handle is pivotably connected to a link at a pivot point between opposite ends of the handle, wherein the position of the pivot point relative to the body is determined by linear adjustment of the link, and the linear adjustment of the link is determined by an adjusting screw adjacent the link, so that linear adjustment in the link is converted to angular motion in the rotating cam.

20. The wrench of claim 19, wherein the second movable jaw is locked when the pivot point located between opposite ends of the handle is closer to the body than a centerline formed between the end of the link adjacent to the adjusting screw and the end of the handle coupled to the cam.

21. The wrench of claim 19, wherein the adjusting screw is coupled to the handle for adjusting the spaced apart distance between the first fixed jaw and the second movable jaw.

22. The wrench of claim 18, further comprising a spring interconnected between the body and the cam for resiliently influencing the cam.

23. The wrench of claim 18, wherein the spring maintains contact between the link and the adjusting screw.

24. The wrench of claim 18, wherein the upper channel is substantially parallel to the channel.

25. The wrench of claim 18, wherein the plurality of ball bearings are uniformly spaced apart from each other and are retained together by a cage separator.

26. The wrench of claim 18, wherein the first fixed jaw and the second movable jaw further comprises interchangeable teeth and means for removably interconnecting the interchangeable teeth to each jaw.

27. The wrench of claim 18, wherein the cam is magnetized and the second movable jaw is a ferrous metal so that a magnetic force is created between the cam and the movable jaw to thereby couple the cam to the movable jaw.

28. The wrench of claim 18, wherein the jaws comprise arcuately shaped jaws, wherein the working surfaces of each jaw is transversely corrugated and defined by a plurality of teeth for the secure gripping of an object.

29. The wrench of claim 18, wherein the jaws each have a lip converging toward the working surface to form an angled edge on each jaw so that a sharp and small working surface area is created, thereby facilitating the pinching of objects within the working surfaces.

30. The wrench of claim 18, wherein the jaws are arcuately shaped.

31. The wrench of claim 18, wherein the jaws comprise duckbill jaws having a wide and elongated flat working surface.

32. The wrench of claim 18, wherein the jaws comprise a nose jaw having a nose base located near the body of the wrench and narrowing away from the nose base to form a needle nose tip, thereby facilitating the gripping of objects that are located in areas that have limited spacing.

33. The wrench of claim 18, wherein the jaws comprise a C-clamp jaw having arcuate arms extending from a shoulder located near the body of the wrench to form a head defined by a flat working surface area, thereby facilitating the clamping of small objects together while working in close areas.

34. The wrench of claim 18, wherein the jaws comprise splayed fingers.

35. A wrench, comprising:

a body having a first fixed jaw;

a second movable jaw residing within a channel formed by the body;

a rotating cam pivotably connected to the body at a first point, wherein the rotating cam interacts with the second movable jaw at a point midway between opposite ends of the base of the second movable jaw, wherein the cam is magnetized and the second movable jaw is a ferrous metal so that a magnetic force is created between the cam and the movable jaw to thereby couple the cam to the movable jaw; and a handle fixedly connected to the rotating cam at a second point so that action of the handle effects a range of motion in the second movable jaw within the channel towards a fully open position and a fully closed position relative to the first fixed jaw.

36. The wrench of claim 35, wherein the handle is pivotably connected to a link at a pivot point between opposite ends of the handle, wherein the position of the pivot point relative to the body is determined by linear adjustment of the link, and the linear adjustment of the link is determined by an adjusting screw adjacent the link, so that linear adjustment in the link is converted to angular motion in the rotating cam.

37. The wrench of claim 36, wherein the second movable jaw is locked when the pivot point located between opposite ends of the handle is closer to the body than a centerline formed between the end of the link adjacent to the adjusting screw and the end of the handle coupled to the cam.

38. The wrench of claim 36, wherein the adjusting screw is coupled to the handle for adjusting the spaced apart distance between the first fixed jaw and the second movable jaw.

39. The wrench of claim 35, further comprising a spring interconnected between the body and the cam for resiliently influencing the cam.

40. The wrench of claim 35, wherein the spring maintains contact between the link and the adjusting screw.

41. The wrench of claim 35, wherein the first fixed jaw includes an upper channel substantially parallel to the channel.

42. The wrench of claim 35, wherein a plurality of ball bearings are disposed within the upper channel.

43. The wrench of claim 35, wherein the plurality of ball bearings are uniformly spaced apart from each other and are retained together by a cage separator.

44. The wrench of claim 35, wherein the upper channel has orthogonally shaped inner ball races defined by the side wall of the upper channel and by the floor of the upper channel.

45. The wrench of claim 35, wherein the first fixed jaw and the second movable jaw further comprises interchangeable teeth and means for removably interconnecting the interchangeable teeth to each jaw.

46. The wrench of claim 35, wherein the jaws comprise arcuately shaped jaws, wherein the working surfaces of each jaw is transversely corrugated and defined by a plurality of teeth for the secure gripping of an object.

47. The wrench of claim 35, wherein the jaws each have a lip converging toward the working surface to form an angled edge on each jaw so that a sharp and small working surface area is created, thereby facilitating the pinching of objects within the working surfaces.

48. The wrench of claim 35, wherein the jaws are arcuately shaped.

49. The wrench of claim 35, wherein the jaws comprise duckbill jaws having a wide and elongated flat working surface.

50. The wrench of claim 35, wherein the jaws comprise a nose jaw having a nose base located near the body of the wrench and narrowing away from the nose base to form a needle nose tip, thereby facilitating the gripping of objects that are located in areas that have limited spacing.

51. The wrench of claim 35, wherein the jaws comprise a C-clamp jaw having arcuate arms extending from a shoulder located near the body of the wrench to form a head defined by a flat working surface area, thereby facilitating the clamping of small objects together while working in close areas.

52. The wrench of claim 35, wherein the jaws comprise splayed fingers.

* * * * *